US006135604A

United States Patent [19]

Lin

[11] Patent Number: 6,135,604

[45] Date of Patent: Oct. 24, 2000

[54] DECORATIVE WATER LAMP

[76] Inventor: Kuo Jung Lin, No. 28, Kuan Ting Street, Tainan, Taiwan

[21] Appl. No.: 09/425,932

[22] Filed: Oct. 25, 1999

[51] Int. Cl.[7] ..... F21V 33/00

[52] U.S. Cl. ..... 362/101; 362/806; 362/318; 362/96; 362/236; 119/254

[58] Field of Search ..... 362/101, 806, 362/96, 230, 231, 318, 86, 234, 383; 119/254, 253

[56] References Cited

U.S. PATENT DOCUMENTS

| | | | |
|---|---|---|---|
| 5,191,319 | 3/1993 | Kiltz | 340/701 |
| 5,234,728 | 8/1993 | Chiang | 428/13 |
| 5,967,639 | 10/1999 | Shih | 362/101 |
| 6,065,850 | 5/2000 | Chiu | 362/101 |

*Primary Examiner*—Sandra O'Shea
*Assistant Examiner*—Ali Alavi
*Attorney, Agent, or Firm*—Bacon & Thomas, PLLC

[57] ABSTRACT

A decorative water lamp includes a water container, a support base located under the water container and having an upper mouth, a light emitter unit fixed under the upper mouth and having a plurality of light emitters (such as LED) of different colors—green, red and blue—to be lit up in various orders to shine the water in the water container through the upper mouth of the support base. Air is blown by a pump controller fixed in the support base through an air tube extending in the water container to produce shocked water current flowing in a regular rhythm added with colored lights from the light emitters, which is controlled to light up in various orders by means of an electronic circuit board powered by a power supplier. Further, a programmed main controller is provided to control turning on and off of the light emitter unit and turning on and off of the pump controller, provided with s speaker sounding out various music in combination with the water current flowing with a regular rhythm and shined with colored lights.

7 Claims, 5 Drawing Sheets

DECORATIVE WATER LAMP

BACKGROUND OF THE INVENTION

This invention relates to a decorative water lamp, particularly to one producing water current flowing in a regular rhythm and colored lights orderly altering, breaking through silent and dull atmosphere in a room, activating visual spectacles, and having decorative effect.

Conventional decorative things generally have lamps or light emitters of different colors for decorating rooms, but producing no fresh or novel feeling or feeling or vision.

SUMMARY OF THE INVENTION

The main objective of the invention is to offer a decorative lamp enjoyable by vision with music, producing water current flowing in a regular rhythm and colored lights alternately lit up to activate silent and dull atmosphere of a room, and having decorative effect as well.

The feature of the invention is a light emitter unit having a plurality of light emitters of different colors to shine water filled in a water container which has an air tube extending from below and connected to a pump controller supplying air through the air tube to flow into the water in the water container to produce water current with bubbles shined by colored lights changing orderly by means of an electronic circuit board.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
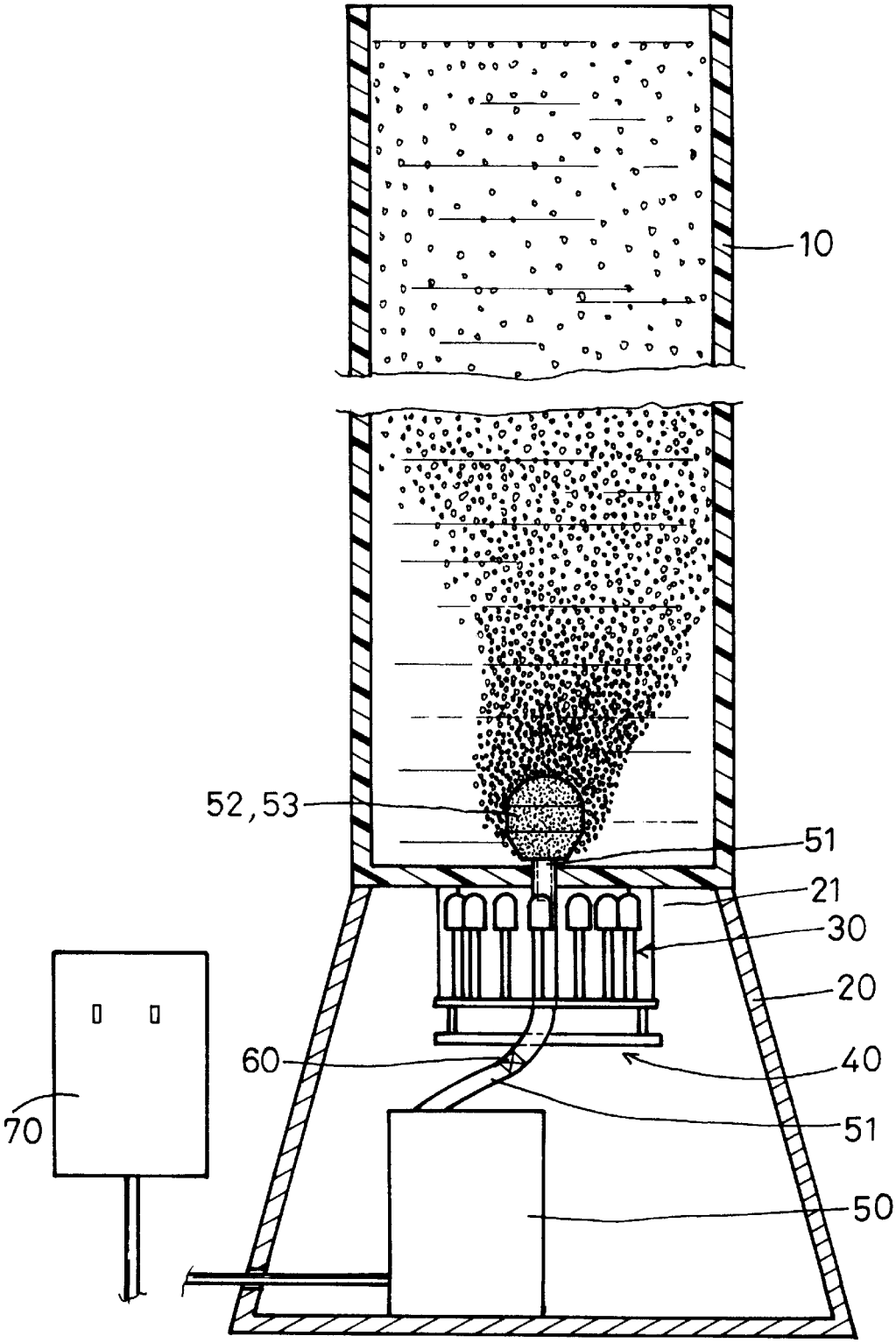
FIG. 1 is a cross-sectional view of a decorative water lamp in the present invention.

A preferred embodiment of a decorative water lamp in the present invention, as shown in FIG. 1, includes a water container 10, a support base 20, a light emitter unit 30, an electronic circuit board 40, a pump controllor 50, a check valve 60, and a power supplier 70 as main components.

The water container 10 has a hollow interior for holding water therein, and a transparent circumferential wall, with water visible from outside.

The support base 20 is located under the bottom of the water container 10, stably supporting the water container 10, having an open upper mouth to function as a light hole 21.

Figure 2:
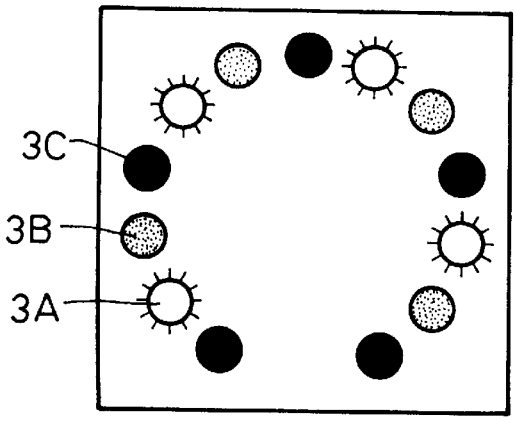
FIG. 2 is a view of a first lighting order for a light emitter unit in the present invention.

The light emitter unit 30 is located just under the light hole 21, having a plurality of light emitters of different colors such as shown in FIG. 2, four green emitters 3A, four red emitters 3B, and five blue emitters 3C (3A, 3B and 3C may be LED, and unlimited in their quantity, the quantity here being only for an example). The light of the emitters 3A, 3B and 3C can reach the interior of the water container 10 through the light hole of the support base 20.

The electronic circuit board 40 is located in the support base 20, controlling lighting order of the light emitters 3A, 3B, and 3C, as shown in FIGS. 2–8.

The pump controller 50 is located in the support base 20, having an air tube 51 extending in the interior of the water container 10 to send air into the water container 10 for producing shocked water current mixed with air bubbles with a regular rhythm in the water container 10.

The check valve 60 is located in the route of the air tube 51, preventing the water in the water container 10 from flowing into the air tube 51 to ruin the pump controller 50.

The power supplier 70 supplies power to the electronic circuit board 40, the pump controller 50 and the light emitter unit 30.

After the water lamp is assembled together, and the power supplier 70 is turned on, it will produce seven kinds of lighting orders described below controlled by the electronic circuit board 40.

Figure 3:
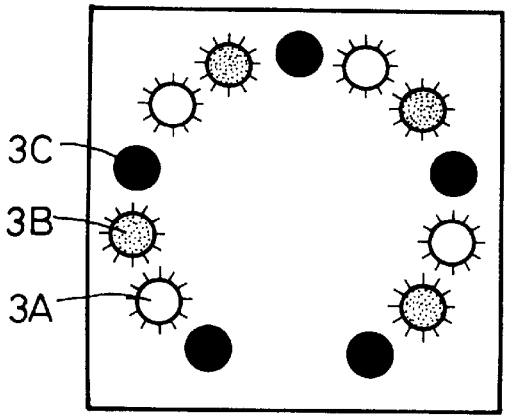
FIG. 3 is a view of a second lighting order for the light emitter unit in the present invention.
Figure 4:
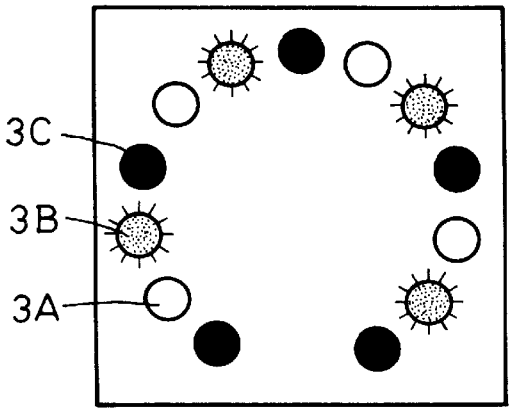
FIG. 4 is a view of a third lighting order for the light emitter unit in the present invention.
Figure 5:
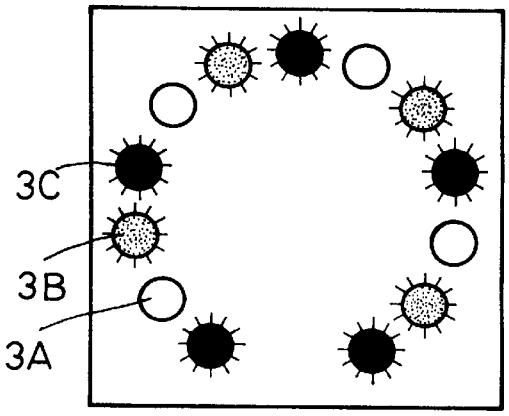
FIG. 5 is a view of a fourth lighting order for the light emitter unit in the present invention.
Figure 6:
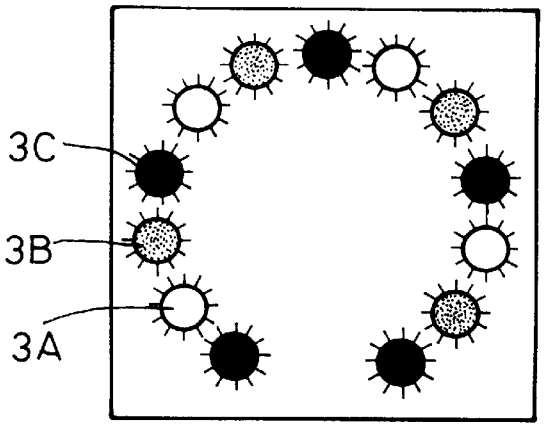
FIG. 6 is a view of a fifth lighting order for the light emitter unit in the present invention.
Figure 7:
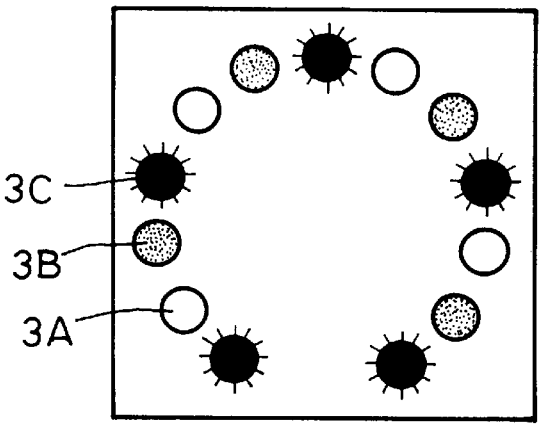
FIG. 7 is a view of a sixth lighting order for the light emitter unit in the present invention.
Figure 8:
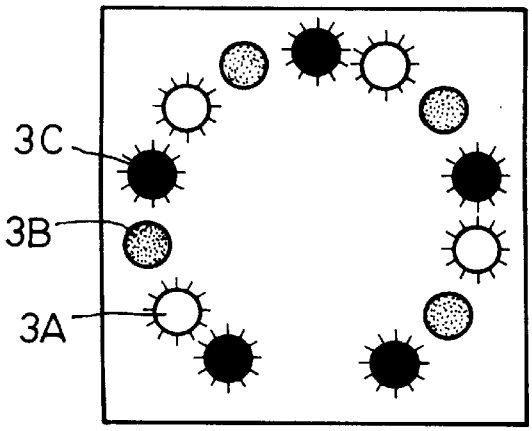
FIG. 8 is a view of a seventh lighting order for the light emitter unit in the present invention.

1. A first one is the green light emitters 3A lit up as shown in FIG. 2, and the water in the water container 10 is moved by the air coming from the air tube 51 of the pump controller 50, producing shocked water current with a regular rhythm, and green colored water current with bubbles.
2. A second one is the green light emitters 3A and the red light emitters 3B are all lit up, as shown in FIG. 3, producing shocked water current with a regular rhythm, and green and red shining colored water current.
3. A third one is the red light emitters 3B lit up and the green light emitters 3A turned off, as shown in FIG. 4, and the water in the water container 10 produces red colored shocked water current flowing in a regular rhythm, with a visual effect as if a flame were burning therein.
4. A fourth one is the red and the blue light emitters 3B and 3C lit up, as shown in FIG. 5, producing red and blue lights shining shocked water current flowing with a regular rhythm.
5. A fifth one is all the red, the blue and the green light emitters 3*b*, 3C and 3A are all lit up, as shown in FIG. 6, producing red, blue and green colored shining shocked water current flowing with a regular rhythm.
6. A sixth one is the blue light emitters 3C only lit up, as shown in FIG. 7, producing blue colored shocked water current flowing with a regular rhythm.
7. A seventh one is blue and green light emitters 3C and 3A lit up, as shown in FIG. 8, producing blue and green colored shocked water current flowing with a regular rhythm.

The decorative water lamp in the invention gives rise to shocked water current with a regular rhythm and visual color alterations, provided with more substantial freshness and color magic, compared with conventional ones.

In addition, the air tube 51 in the water container 10 is further provided with an air valve 52 with many holes on the upper end and a foam sheet 53 covering the air valve 52 for filtering air.

Further, a manual changeover switch (not shown in the figures) may be attached on an outer side of the support base 20, for manually turning on and off the light emitters 3A, 3B, 3C selectably.

Further, a manual air volume switch (not shown in the figures) may be attached on an outer side of the support base 20 for controlling air volume of the pump controller 50 to permit the water in the water container to move with different force (strong or weak) for obtaining soft or strong water current to get alterations.

Figure 9:
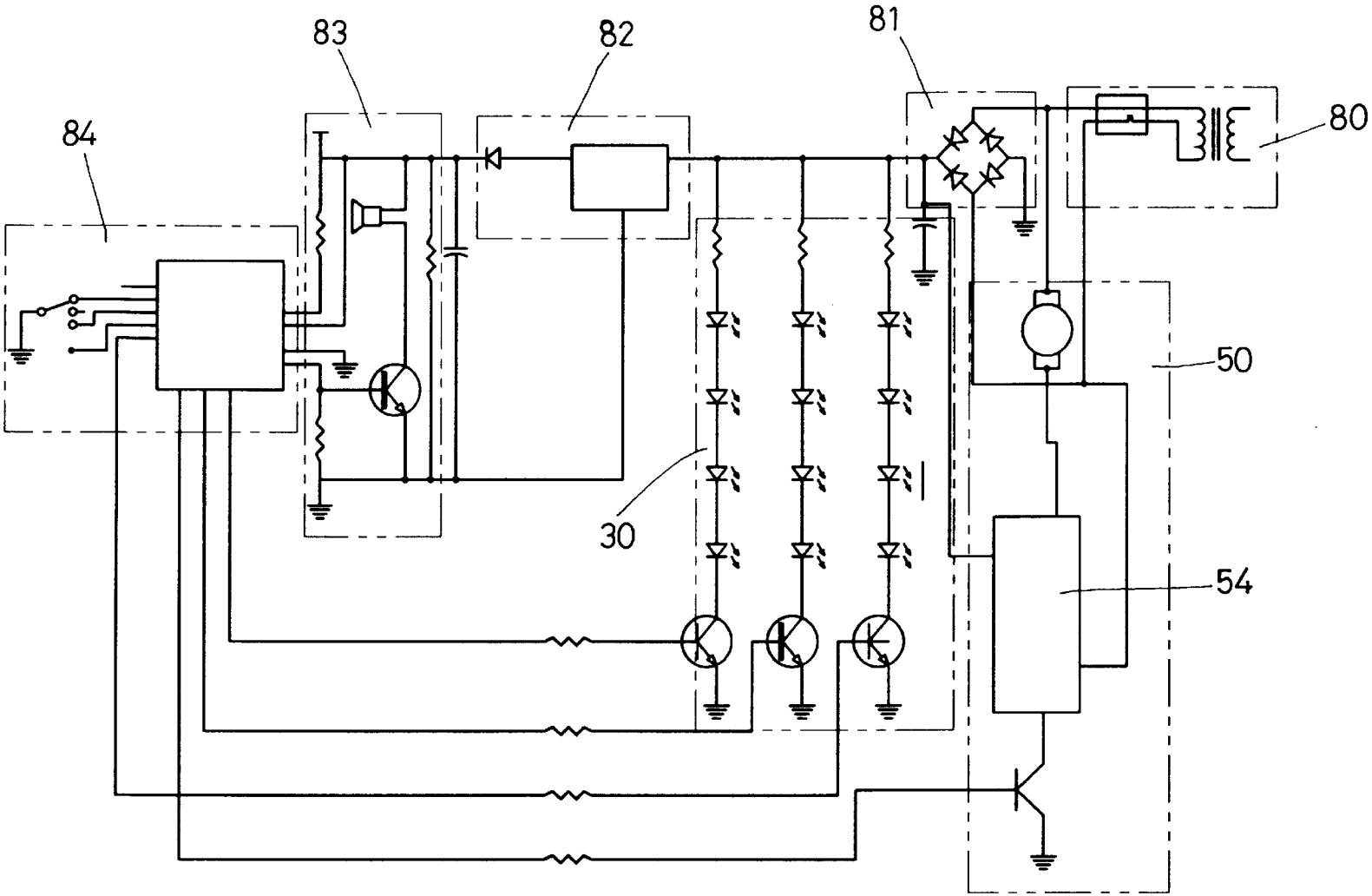
FIG. 9 is a connecting chart of an electronic circuit in the present invention; and, FIG. 10 is a block chart of a controlling system in the present invention.
Figure 10:
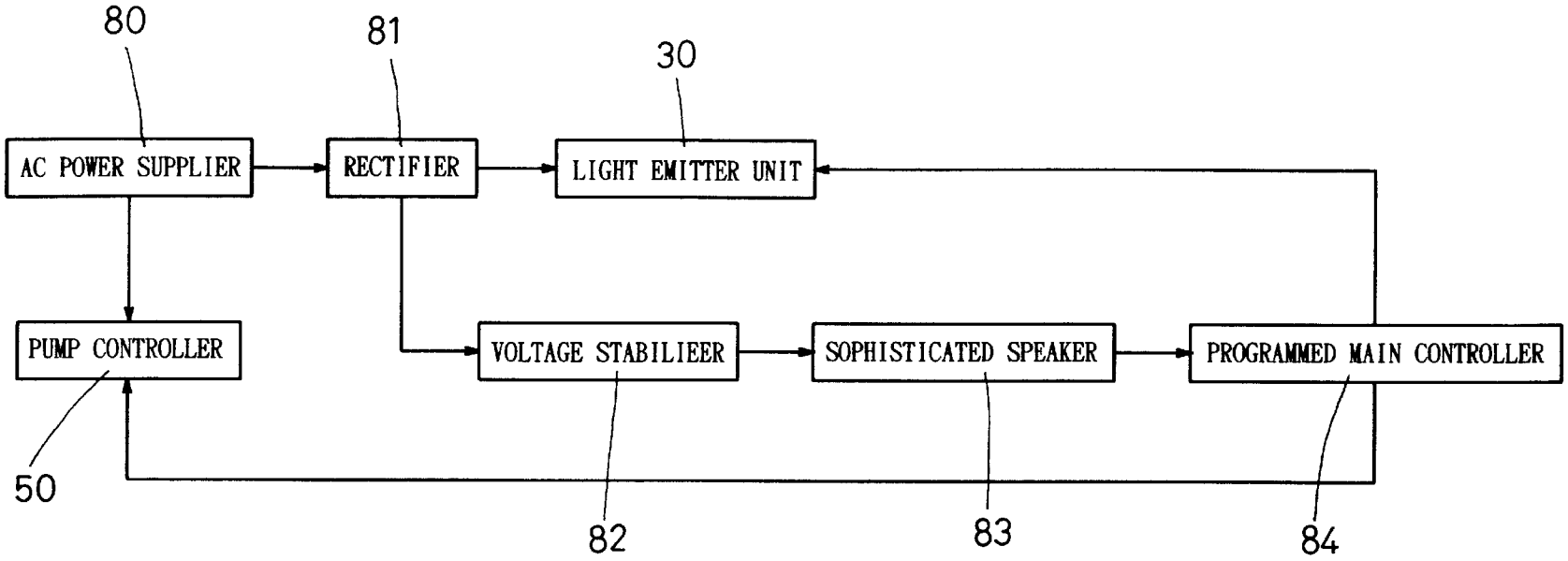

Next, as shown in FIG. 9, the electronic circuit for the decorative water lamp includes an AC power supplier 80, a rectifier 81, the light emitter unit 30 (such as LED), a voltage stabilizer 82, a speaker 83, a programmed main controller 84, and the pump controller 50 properly connected together. The block chart of the invention is shown in FIG. 10.

The AC power supplier 80 has a plug having function of changing voltage (such as AC110 V, 220 V into AC12 V), supplying voltage altered to the pump controller 50 to start it.

The rectifier 81 is a bridge, rectifying AC of the AC power supplier 80 into AC or DC to be supplied to the following components.

The light emitter unit 30 as described above.

The voltage stabilizer 82 receives the rectified current of the rectifier 81, supplying more stable voltage to the sophisticated speaker 83 and the programmed main controller 84, permitting them to operate stably and not easily get burned up.

The speaker 83 is controlled by the programmed main controller 84, changing sound and music according to the program set in the programmed controller 84, possible to sound out many various kinds of music sound (such as piano, strings, or strong modern music, etc, etc.).

The programmed main controller 84 may be an IC with a program recorded on it, functioning as a micro computer, controlling turning on and off of the light emitter unit 30 and turning on and off of the pump controller 50, and activating the speaker 83 to sound out a variety of music sounds.

The pump controller 50 as described above.

In general, the decorative water lamp has visual alterations of water current with a regular rhythm and colored lights, and further the water current is controlled by the programmed main controller 84 dominating the pump controller 50 and the sounds of the speaker 83. Therefore, the decorative water lamp can let people enjoy both visual and acoustic entertainment at the same time, with music coming from the speaker 83 in combination with water bubble dancing spectacles by on-and-off operation of the pump controller 50 combined with the programmed main controller 84 and colored lights by the light emitter unit 30. Above all, strength of water current and loudness of music correspond to each other, with loud music accompanied by long water current with bubbles, with weak music accompanied by short air bubbles, etc., altering its rhythm to prevent monotony.

For music lovers and beauty lovers, this water lamp can satisfy their likings, being a novel originality.

While the preferred embodiment of the invention has been described above, it will be recognized and understood that various modifications may be made therein and the appended claims are intended to cover all such modifications which may fall within the spirit and scope of the invention.

I claim:

1. A decorative water lamp comprising:

a water container having a hollow interior for holding water, and a transparent circumferential wall to be seen through from outside;

a support base fixed under the bottom of said water container to secure the same stably, having an upper mouth as a light hole for light to pass through;

a light emitter unit located just under said light hole of said supporting base, having a plurality of light emitters of different colors, said light of said light emitters shining through said light hole of said support base into the interior of said water container;

an electronic circuit board controlling turning on and off and lighting order of said light emitters of said light emitter unit;

a pump controller fixed in said support base, having an air tube extending through said light hole of said support base in the interior of said water container, water in said water container producing shocked water current flowing in a regular rhythm and said light emitters lit up in various orders when said pump controller and said electronic circuit board are powered;

a check valve provided in the route of said air tube of said pump controller, preventing the water in said water container from flowing into said air tube to said pump controller; and, a power supplier supplying power to said electronic circuit board, said pump controller, and said light emitter unit.

2. The decorative water lamp as claimed in claim 1, wherein said air tube extending in the interior of said water container further has an air valve with many small holes fixed on an upper end, and a foam sheet covered around said air valve.

3. The decorative water lamp as claimed in claim 1, wherein a manual change-over switch is further provided on an outer side of said support base for driving said electronic circuit board to manually select lighting order of said light emitters.

4. The decorative water lamp as claimed in claim 1, wherein said light emitters are LED.

5. The decorative water lamp as claimed in claim 1, wherein a manual air quantity switch is further provided on the outer side of said support base, manually controlling air quantity blown out of said pump controller so as to alter strength of water current caused in said water container.

6. The decorative water lamp as claimed in claim 1, wherein said pump controller has a function in altering strength of air flowing through said air tube into said water container so as to alter strength of water current therein.

7. The decorative water lamp as claimed in claim 1, wherein a programmed main controller is further provided in said power supplier, controlling lighting order of said light emitter unit and turning on and off time of said pump controller, and a speaker connected with said programmed main controller to sound out various music to correspond to turning on and off of said pump controller, for obtaining synchronous operation of colored water current and music.

* * * * *